US006698066B2

(12) United States Patent
Latham

(10) Patent No.: US 6,698,066 B2
(45) Date of Patent: Mar. 2, 2004

(54) METHOD AND APPARATUS FOR FIBER BATT TREATMENT

(75) Inventor: Keith Latham, Plainview, TX (US)

(73) Assignee: Lummus Corporation, Savannah, GA (US)

( * ) Notice: Subject to any disclaimer, the term of this patent is extended or adjusted under 35 U.S.C. 154(b) by 0 days.

(21) Appl. No.: 09/683,096

(22) Filed: Nov. 16, 2001

(65) Prior Publication Data

US 2002/0088590 A1 Jul. 11, 2002

Related U.S. Application Data

(63) Continuation of application No. 09/776,181, filed on Feb. 3, 2001.
(60) Provisional application No. 60/179,597, filed on Feb. 2, 2000.

(51) Int. Cl.[7] ..... D01B 3/04
(52) U.S. Cl. ..... 19/66 CC; 19/65 A; 19/66 R
(58) Field of Search ..... 19/65 A, 65 R, 19/66 R, 66.1, 66.2, 66 CC, 296, 144, 308, 39; 264/112, 118, 121

(56) References Cited

U.S. PATENT DOCUMENTS 4,103,397 A * 8/1978 Jackson ..... 100/74
4,726,096 A * 2/1988 Woods, Jr. ..... 19/21
5,381,587 A * 1/1995 Vandergriff ..... 19/48 R
6,202,258 B1 * 3/2001 Winn ..... 19/39
6,314,618 B1 * 11/2001 Mehner et al. ..... 19/308

* cited by examiner

*Primary Examiner*—Gary L. Welch
(74) *Attorney, Agent, or Firm*—Hunton & Williams

(57) ABSTRACT

A method and apparatus for conditioning a fibrous material. The conditioning arrangement includes a moisturizing chamber having two series of opposed rollers arranged to accept a fiber batt into a pressing space therebetween. The pressing space tapers from a batt entrance toward a batt exit. This tapered configuration is affected for compressing a fiber batt as it is rolled therethrough. As illustrated, before entering the conditioner, the cotton batt has a greater thickness than after compaction and processing through the moisturizing chamber. A moisture infusion assembly is provided within the moisturizing chamber and has an air distributor configured to dispense moisture laden air adjacent to a fiber batt being processed through the pressing space. An air collector is configured to pull exhaust air away from the fiber batt being processed through the pressing space. The moisturizing chamber is configured to confine and circulate dispensed moisture laden air through the fiber batt being processed through the pressing space for optimizing a finished moisture content thereof.

20 Claims, 7 Drawing Sheets

METHOD AND APPARATUS FOR FIBER BATT TREATMENT

CROSS REFERENCE TO RELATED APPLICATIONS

This is a continuation application of, and incorporates by reference in its entirety, U.S. patent application Ser. No. 09/776,181 filed Feb. 3, 2001.

BACKGROUND OF INVENTION

Background Art.

The use of cleaning, compaction and baling equipment is well known in the raw cotton processing industries. Typically, the cotton comes in a "raw" condition to a processing plant commonly referred to as a gin where the stalk and other parts of the plant extraneous to the actual cotton fibers is removed as thoroughly as possible. The cleaned cotton bolls are then formed into a batt which is essentially a sheet formed of cotton fibers. This cotton batt is typically conditioned by adding moisture thereto. The addition of moisture to the batt imparts advantageous effects because it facilitates compaction by making the cotton fibers more amenable to being bent, crushed and flattened into a more compact batt.

One drawback of currently available equipment for adding moisture to such a cotton batt is that the degree of moisturization is difficult to control. Secondly, the configurations used for compacting the batt do not readily facilitate anomalies in the batt, especially with respect to thickness. That is to say, if a significant enlargement or lump is encountered in a batt being processed therethrough, presently available compaction equipment does not make suitable accommodations for the deviation. Still further, conventionally designed arrangements tend to accomplish the moisturizing step over a significant distance which is not easily controlled and the moisturized air is not easily contained about the batt for a more thorough infusion and emplacement of the moisture into the cotton fibers. An example of such a known arrangement is provided in FIG. 4 in which louvers are arranged to distribute moisturized air underneath the batt with very little control exercised thereover.

In view of the above described deficiencies associated with the use of known designs for moisturizing equipment for fibrous material, and particularly cotton batts, the present invention has been developed to alleviate these drawbacks and provide further benefits to the user. These enhancements and benefits are described in greater detail hereinbelow with respect to several alternative embodiments of the present invention.

BRIEF DESCRIPTION OF DRAWINGS

The invention will now be described in greater detail in the following way of example only and with reference to the attached drawings, in which.

DETAILED DESCRIPTION

Figure 1:
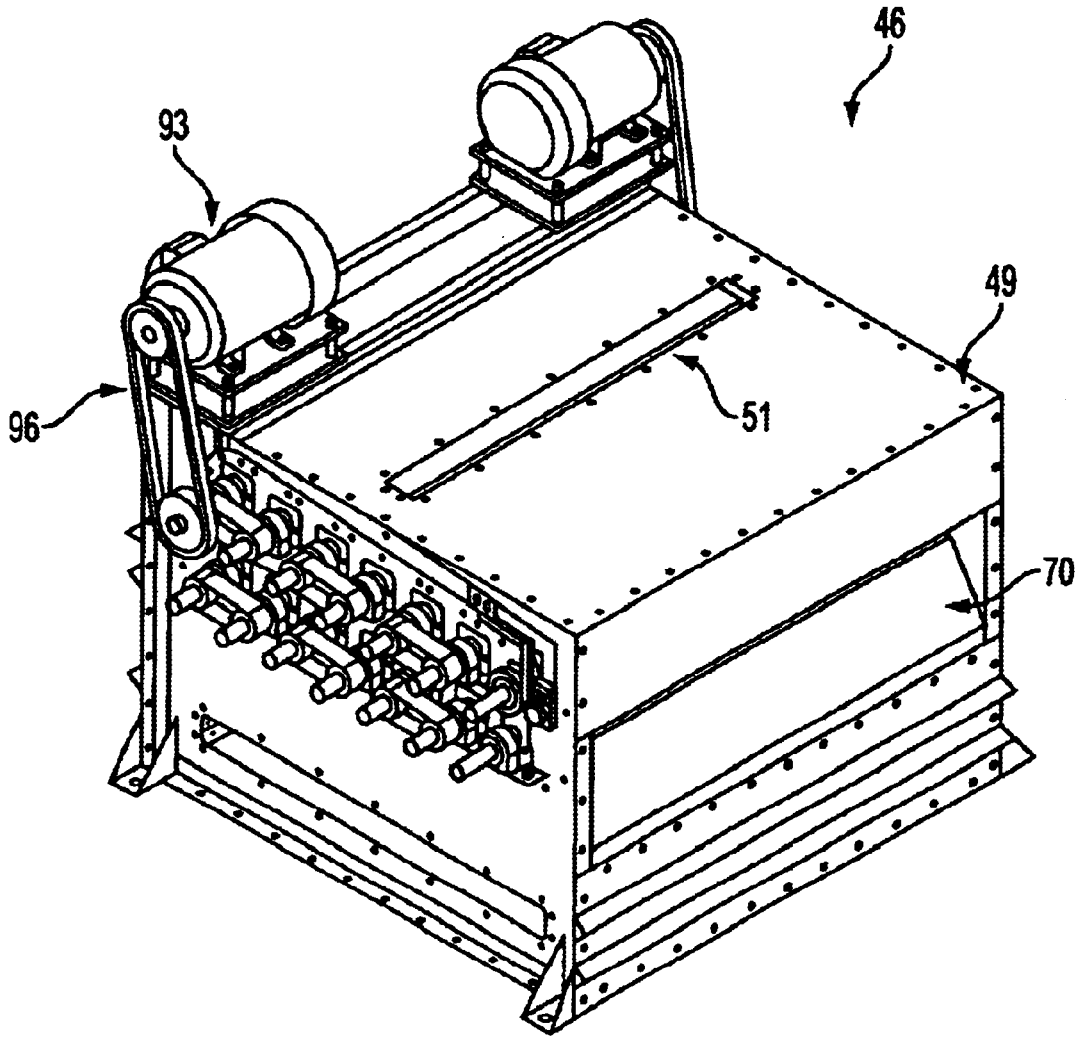
FIG. 1 is a perspective view of exterior characteristics of a moisturizing chamber constructed according to the teachings of the present invention.
Figure 2:
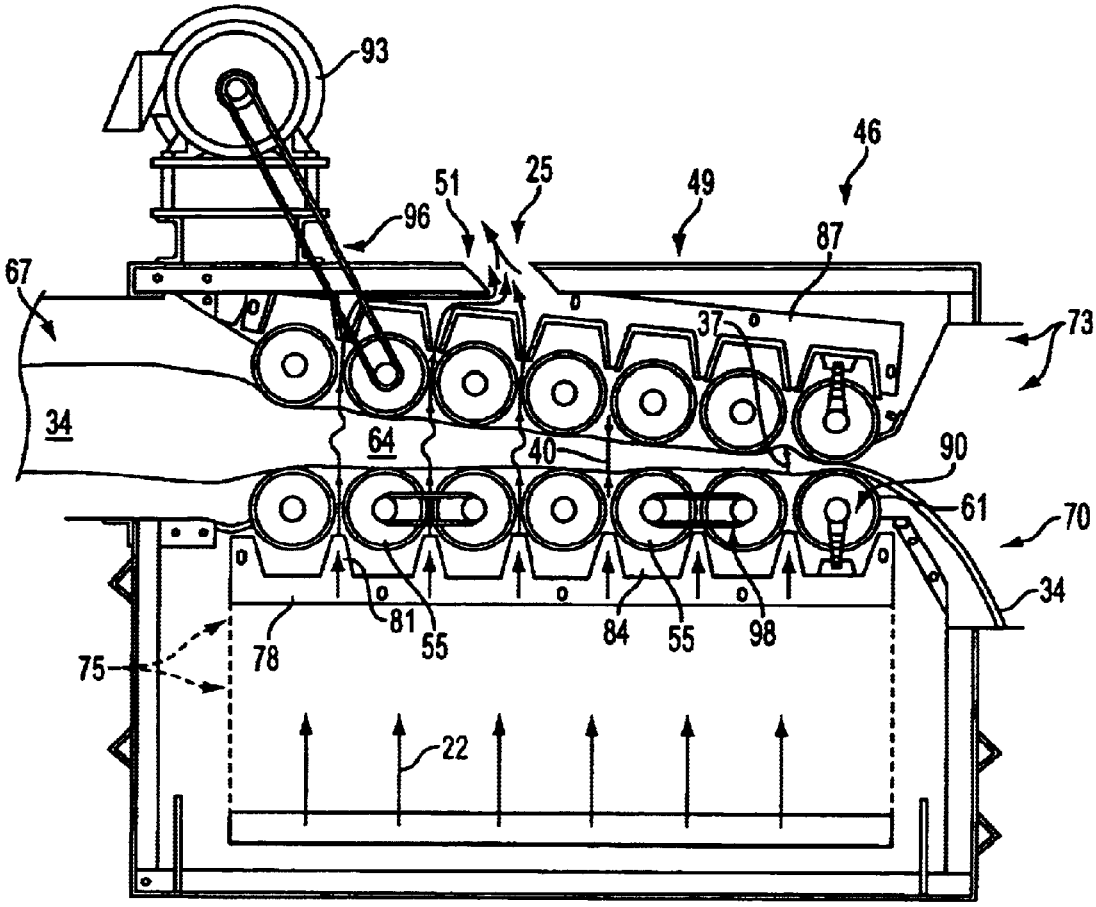
FIG. 2 is a cut-away view showing interior components of a moisturizing chamber constructed according to the teachings of the present invention.

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Referring to the Figures, an arrangement 46 for conditioning a fibrous material 34 obtained from a cotton source 12 is shown. The environment in which the conditioning arrangement 46 may be typically incorporated is exemplarily illustrated in FIG. 3 by its inclusion in a cotton batt processing plant. The conditioning arrangement 46 includes a moisturizing chamber 49 having two series of opposed rollers 61 arranged to accept a fiber batt 34 into a pressing space 64 therebetween. In the illustrated embodiment, the fibrous material 34 is cotton that has been formed into a batt. It should be appreciated, however, that the fibrous material may be of different composition including, but not limited to polyesters and other natural and synthetic fibers, as well as combinations of such fibrous materials alone, and with other materials of differing characteristics.

The pressing space 64 tapers from a batt entrance 67 toward a batt exit 70. This tapered configuration is affected for compressing a fiber batt 34 as it is rolled therethrough. As illustrated, before entering the conditioner 46, the cotton batt 34 has a greater thickness 40 than after compaction and processing through the moisturizing chamber 49.

A moisture infusion assembly 73 is provided within the moisturizing chamber 49 and has an air distributor 75 configured to dispense moisture laden air 22 adjacent to a fiber batt 34 being processed through the pressing space 64. An air collector 87 is configured to pull exhaust air 25 away from the fiber batt 34 being processed through the pressing space 64 and port that air 25 through an exhaust air port 51 for recirculation or venting. The moisturizing chamber 49 is configured to confine and circulate dispensed moisture laden air 22 through the fiber batt 34 being processed through the pressing space 64 for optimizing a finished moisture content thereof.

From a supplier or grower's perspective, the greater the moisture content established in the cotton batt 34, the better. Not only does a higher moisture content facilitate compaction of the batt 34, but it also increases the weight of the batt 34 thereby increasing the yield or margin for the same cotton material at sale.

At least one of the rollers 55 is carried upon a spring biased suspension 90. Such a spring biased suspension 90 is utilized for biasing or pressing the roller 55 toward the pressing space 64 and batt 34. By adding this feature, it is now possible to accommodate anomalies 37 in a fiber batt 34 being processed through the pressing space 64. Most often such an anomaly takes the form of a lump or variation in thickness 40 of the batt 34.

In the preferred embodiment and as illustrated, the last two rollers 55, one each from the top and bottom series of opposed rollers 61, are carried on a spring biased suspension 90. It should be appreciated that the specific type of biasing mechanism is not critical to operation as long as the suspension mechanism is adapted to impart sufficient pressure to continue and enhance the compaction process of the tapered pressing space 64, but still have sufficient "give" to accommodate an anomalous thickness in the batt 34 which would otherwise be potentially damaging to the conditioner 46, or threaten to cease operations thereof.

The rollers 55 are illustratively powered by a two driving motors 93 that are, one each, coupled to the top and bottom series of rollers 61 by a drive belt 96. It is contemplated that a single drive motor may be used to drive both series of rollers 61.

As illustrated, drive connections across the series of rollers 61 is accomplished by using coupling belts 98 between adjacent rollers 55 at alternating ends of the series of opposed rollers 61.

Figure 3:
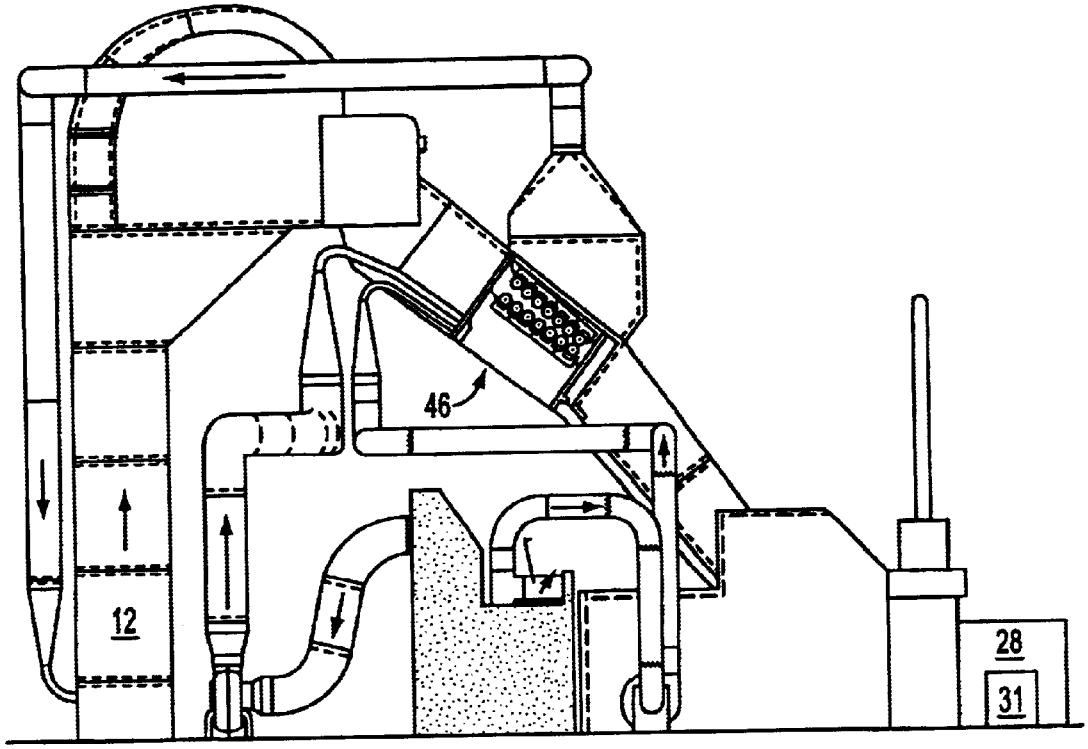
FIG. 3 is a schematic illustration of relevant portions of a fiber processing plant, particularly a cotton fiber processing plant, illustrating the incorporation of an arrangement for moisture conditioning a cotton fiber batt as disclosed herein.
Figure 4:
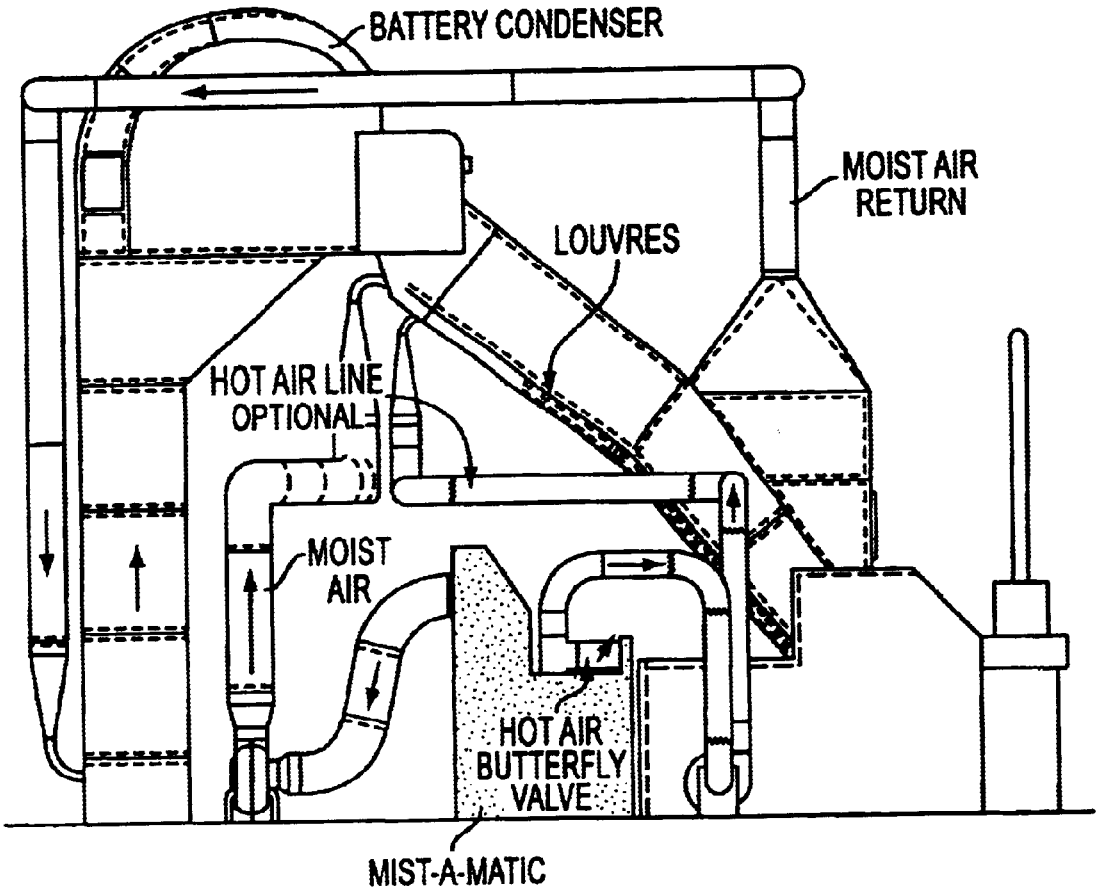
FIG. 4 PRIOR ART
FIG. 4 is a schematic illustration of a prior art embodiment of a cotton fiber processing plant that utilizes a previously known arrangement for imparting moisture to a fiber batt being processed therein.

Regarding the width dimension of the batt 34, it should be considered as being measured perpendicularly to the thickness 40, and oriented as if into the paper of FIG. 3. Preferably, this majority of the width will cover a substantial entirety of the width of the fiber batt 34 being processed through the pressing space 64.

Preferably, there is a plurality or multiplicity of focused ports 81 coming off of the manifold 78. The illustrated configuration shows such a plurality of focused and elongate and focused ports 81 positioned between adjacent rollers 55. In this manner, the several focused ports 81 are arranged to form roller receiving spaces 84 between adjacently positioned rollers 55. While this configuration provides a suitable receiving space for the rollers and enables more direct application of moisture laden air 22 to the cotton batt 34, it can also provide a space for stray cotton material to become easier trapped or jammed. Therefore, an alternative embodiment places the focused port 84 below the rollers 55 at a distance that prevents such a possibility of jamming. This alternative configuration, however, does not permit such a direct application of moisture laden air 22 to the cotton batt 34.

An alternative embodiment of the present invention takes the form of a method for conditioning a fiber batt 34. The method includes providing a moisturizing chamber having a series of opposed rollers arranged to accept a fiber batt 34 a pressing space 64 therebetween. The pressing space 64 tapers from a batt entrance 67 to a batt exit 70 thereof.

The fiber batt is compressed by rolling the fiber batt through the pressing space 64. Moisture is then infused into the fiber batt 34 through an infusion assembly 73 having an air distributor 75 configured to dispense moisture laden air 22 adjacent to the fiber batt 34 that is being processed through the pressing space 64.

Exhaust air 25 is then pulled away from the fiber batt 34 being processed through the pressing space 64 using an air collector 87 positioned across the fiber batt 34 from the infusion assembly 73.

The dispensed moisture laden air 22 is circulated through the fiber batt 34 being processed through the pressing space 64 for optimizing a finished moisture content of the fiber batt 34. This is enabled by the confining nature of the moisturizing chamber 49 that maintains the moisture laden air 22 in close proximity with the passing fiber batt 34 for a specified duration.

By these characteristics, the present invention encourages the retention of moisture in the fiber batt 34 from the moisture laden air 22 thereby increasing the weight of the fiber batt 34. As explained hereinabove, this enhancement of the moisture content of the batt not only facilitates compaction of the fibers, but it also increases the yield to the seller of a specific quantity of cotton fiber because selling price is usually based on weight.

Downstream of the conditioning process, the cotton fiber batt 34 is normally formed into a transportable bulk units commonly referred to as cotton bales 31 at a baling assembly 28.

A fibrous material moisturizing method, apparatus and constituent components have been described herein. These and other variations, which will be appreciated by those skilled in the art, are within the intended scope of this invention as claimed below. As previously stated, detailed embodiments of the present invention are disclosed herein; however, it is to be understood that the disclosed embodiments are merely exemplary of the invention that may be embodied in various forms.

Figure 5:
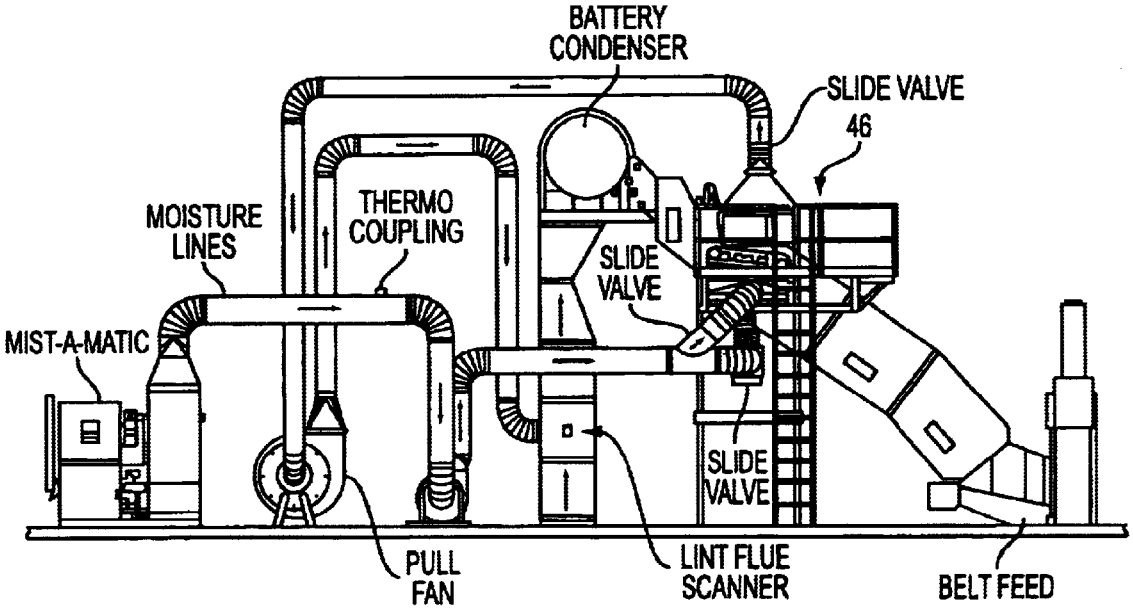
FIG. 5 is an assembly drawing of an additional embodiment of the present invention.
Figure 6:
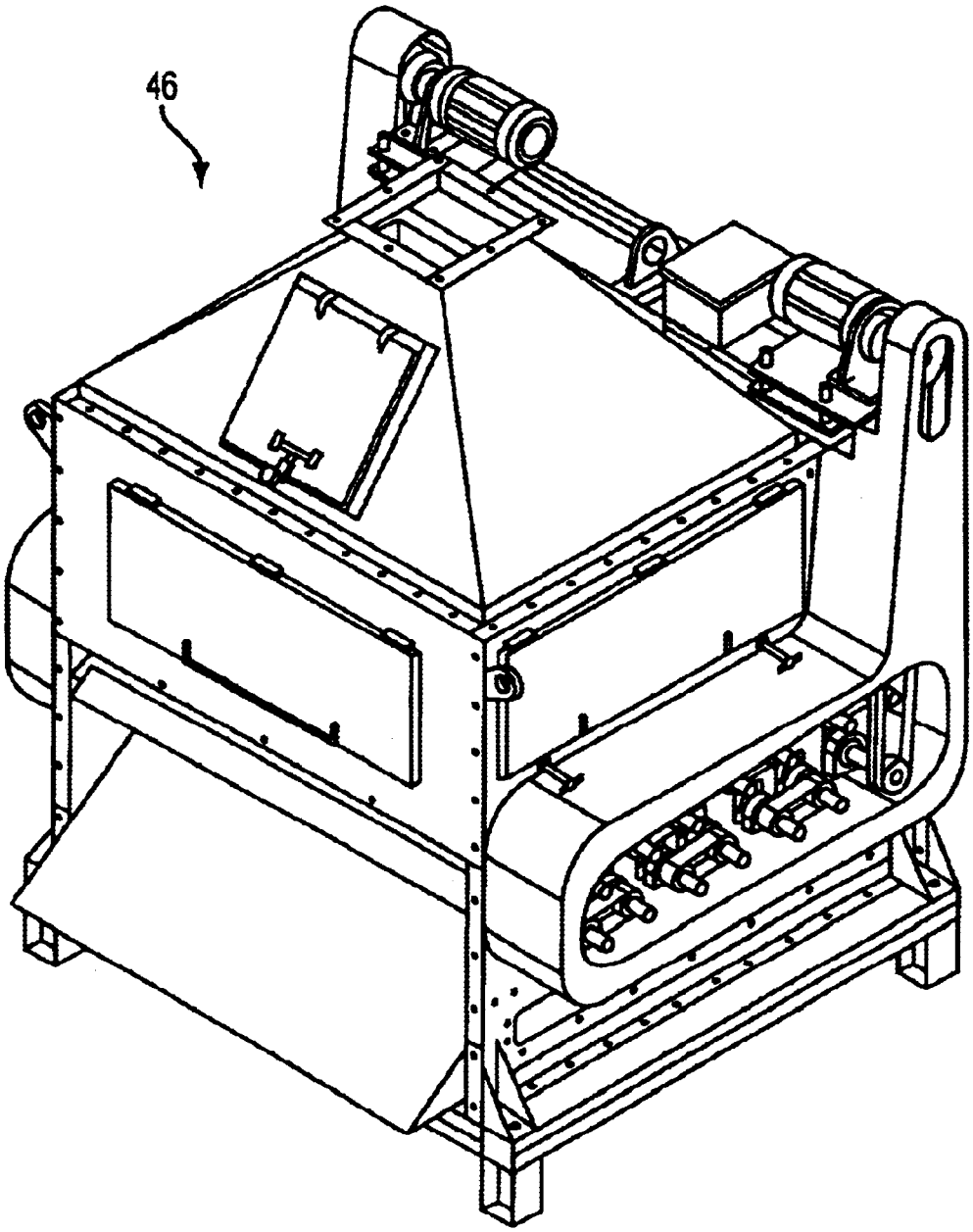
FIG. 6 is an exterior perspective view of the arrangement for conditioning a fibrous material obtained from a cotton source.
Figure 7:
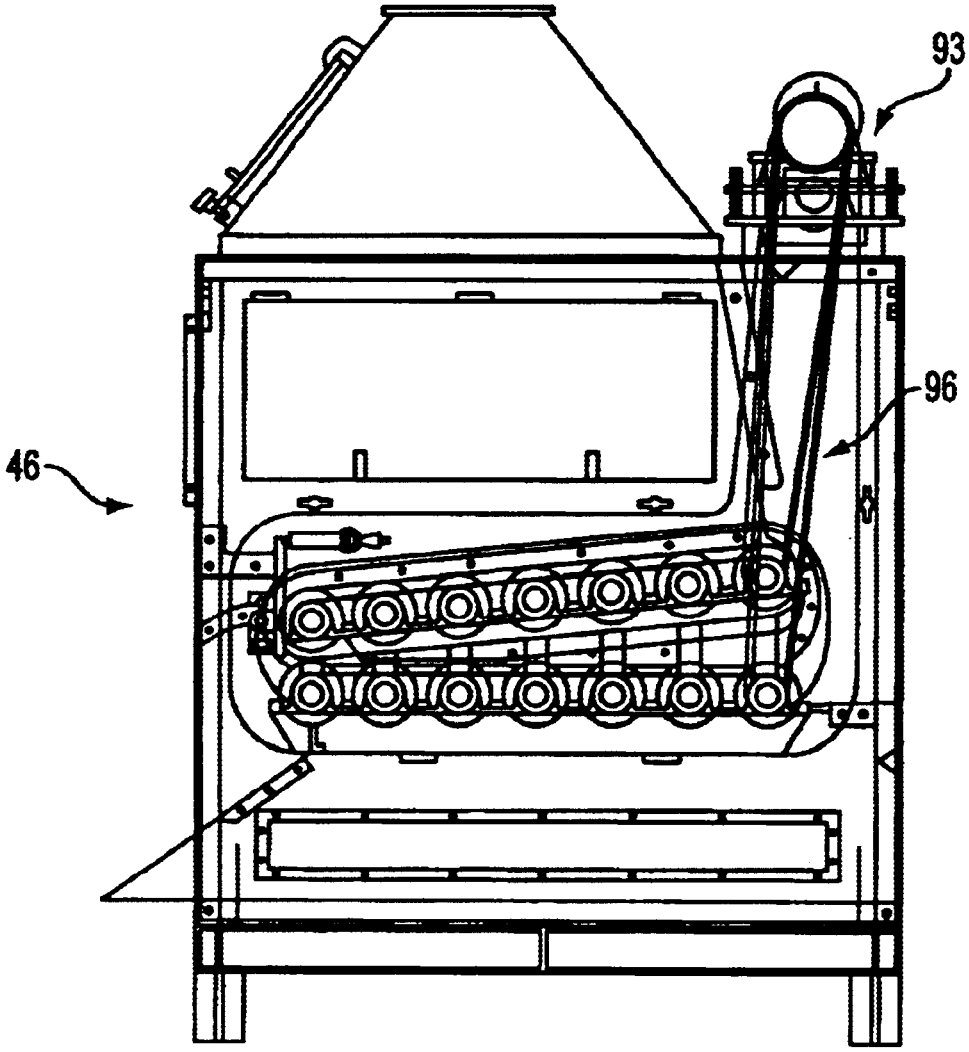
FIG. 7 is a partial cut-away view of the arrangement of FIG. 6 showing interior details of the conditioning arrangement.

FIGS. 5–7 illustrate an alternative arrangement including some of the characteristics of the arrangement of FIGS. 1–4, but including several alternative configurations and enhancements.

INDUSTRIAL APPLICABILITY

The present invention finds applicability in the fiber processing industries.

What is claimed is:

1. An arrangement for conditioning a fiber batt; said arrangement comprising:

a moisturizing chamber having a series of opposed rollers arranged to accept a fiber batt in a pressing space therebetween, said pressing space tapering from a batt entrance to a batt exit thereof for compressing a fiber batt when rolled therethrough;

a moisture infusion assembly having an air distributor configured to dispense moisture laden air adjacent to a fiber batt being processed through said pressing space and an air collector configured to pull exhaust air away from a fiber batt being processed through said pressing space; and said moisturizing chamber configured to circulate dispensed moisture laden air through a fiber batt being processed through said pressing space for optimizing a finished moisture content thereof.

2. The arrangement as recited in claim 1, further comprising:

at least one of said rollers is carried upon a spring biased suspension for biasing said at least one of said rollers toward said pressing space thereby accommodating anomalies in a fiber batt being processed through said pressing space.

3. The arrangement as recited in claim 1, further comprising:

at least one of said rollers is carried upon a spring biased suspension for biasing said at least one of said rollers toward said pressing space thereby accommodating thickness changes in a fiber batt being processed through said pressing space.

4. The arrangement as recited in claim 1, further comprising:

each of an oppositely arranged pair of said rollers being carried upon a spring biased suspension for biasing said at least one of said rollers toward said pressing space thereby accommodating anomalies in a fiber batt being processed through said pressing space.

5. The arrangement as recited in claim 1, wherein said rollers are powered by at least one driving motor.

6. The arrangement as recited in claim 1, wherein said rollers are driven by a common drive belt.

7. The arrangement as recited in claim 1, wherein said rollers are coupled into adjacent pairs by a coupling belts.

8. The arrangement as recited in claim 1, wherein said air distributor further comprises:

a manifold configured to distribute air across at least a majority of a width of a fiber batt being processed through said pressing space.

9. The arrangement as recited in claim 1, wherein said air distributor further comprises:

a manifold configured to distribute air across a substantial entirety of a width of a fiber batt being processed through said pressing space.

10. The arrangement as recited in claim 1, wherein said air distributor further comprises:

at least one focused port positioned for distributing moisture laden air between two adjacent rollers of said series of opposed rollers.

11. The arrangement as recited in claim 1, wherein said air distributor further comprises:

a plurality of focused ports, each one of said plurality of focused ports positioned for distributing moisture laden air between two adjacent rollers of said series of opposed rollers.

12. The arrangement as recited in claim 11, wherein said plurality of focused ports are arranged to form roller receiving spaces between adjacently positioned rollers.

13. A method for conditioning a fiber batt; said method comprising:

providing a moisturizing chamber having a series of opposed rollers arranged to accept a fiber batt in a pressing space therebetween, said pressing space tapering from a batt entrance to a batt exit thereof;

compressing said fiber batt by rolling said fiber batt through said pressing space;

infusing moisture through an infusion assembly having an air distributor configured to dispense moisture laden air adjacent to said fiber batt being processed through said pressing space;

pulling exhaust air away from said fiber batt being processed through said pressing space using an air collector positioned across said fiber batt to said infusion assembly; and circulating dispensed moisture laden air through said fiber batt being processed through said pressing space for optimizing a finished moisture content of said fiber batt.

14. The method as recited in claim 13, further comprising:

suspending at least one of said rollers upon a spring biased suspension, said suspension adapted for biasing said at least one of said rollers toward said pressing space thereby accommodating anomalies in said fiber batt being processed through said pressing.

15. The method as recited in claim 13, further comprising:

suspending each of an oppositely arranged pair of said rollers upon a spring biased suspension arranged for biasing said at least one of said rollers toward said pressing space thereby accommodating anomalies in said fiber batt being processed through said pressing space.

16. The method as recited in claim 13, further comprising:

configuring a manifold to distribute air across at least a majority of a width of a fiber batt being processed through said pressing space.

17. The method as recited in claim 13, further comprising:

configuring said air distributor to include at least one focused port positioned for distributing moisture laden air between two adjacent rollers of said series of opposed rollers.

18. The method as recited in claim 13, further comprising:

retaining moisture in said fiber batt from said moisture laden thereby increasing the weight of said fiber batt.

19. The method as recited in claim 13, further comprising:

forming said fiber batt from cotton fibers.

20. The method as recited in claim 19, further comprising:

forming said cotton fiber batt into a transportable bale.

* * * * *